US005393396A

United States Patent [19]

DeWitt et al.

[11] Patent Number: 5,393,396

[45] Date of Patent: Feb. 28, 1995

[54] APPARATUS FOR ELECTRODEPOSITING METAL

[75] Inventors: Robert D. DeWitt, Lyndhurst; Adam G. Bay, Chesterland; Tibor Paraday, Eastlake, all of Ohio

[73] Assignee: Gould Inc., Eastlake, Ohio

[21] Appl. No.: 605,648

[22] Filed: Oct. 30, 1990

[51] Int. Cl.[6] ..... C25D 7/06; C25D 17/00; C25D 17/10

[52] U.S. Cl. ..... 204/206; 204/281

[58] Field of Search ..... 204/206, 281

[56] References Cited

U.S. PATENT DOCUMENTS

| | | | |
|---|---|---|---|
| 740,359 | 9/1903 | Fletcher | 205/143 |
| 2,271,735 | 2/1942 | Hall | 204/206 |
| 2,342,688 | 2/1944 | Paynter | 204/199 |
| 2,618,593 | 7/1949 | Rossel | 204/199 |
| 3,151,048 | 9/1964 | Conley et al. | 205/77 |
| 3,443,996 | 5/1969 | Falk et al. | 136/82 |
| 3,445,371 | 5/1969 | Johnston | 204/206 |
| 3,461,064 | 8/1969 | Clancy | 208/213 |
| 3,483,098 | 12/1969 | Kramer | 205/130 |
| 3,483,113 | 12/1969 | Carter | 204/206 |
| 3,634,223 | 1/1972 | Carter | 204/206 |
| 3,767,537 | 10/1973 | Selker | 204/208 X |
| 3,901,785 | 8/1975 | Buzhinskaya et al. | 204/208 |
| 4,318,794 | 3/1982 | Alder | 204/216 |
| 4,692,221 | 9/1987 | Parthasarathi | 205/77 |
| 4,702,812 | 10/1987 | Economopoulos | 204/208 |
| 4,778,571 | 10/1988 | Nakatsugawa | 205/77 |
| 4,898,647 | 2/1990 | Luce et al. | 205/108 |
| 5,017,275 | 5/1991 | Niksa | 204/206 |

FOREIGN PATENT DOCUMENTS

| | | |
|---|---|---|
| 2324834 | 9/1974 | Germany . |
| 1543301 | 4/1979 | United Kingdom . |

OTHER PUBLICATIONS

Vol. 14, No. 555 (C-78) Dec. 10, 1990, JP-A-02 236 297 (Nisshin Steel Co.).

*Primary Examiner*—Donald R. Valentine

*Attorney, Agent, or Firm*—D. Peter Hochberg; Mark Kusner; Michael Jaffe

[57] ABSTRACT

An apparatus for electrodeposition of metal comprising an anode assembly and a moving cathode having a plating surface. The anode assembly and the cathode are spaced apart a predetermined distance to define an interelectrode gap therebetween. The anode assembly is comprised of an anode cradle having a non-conductive surface of a predetermined contour facing the cathode, and a plurality of deformable metallic anodes of general uniform thickness. The anodes have a configuration which nearly conforms to the contour of the non-conductive surface of the anode cradle. The deformable anodes are secured to the anode cradle such that the anodes are deformed into mating engagement with the non-conductive surface of the anode cradle to conform to the predetermined contour thereof. Means are provided for connecting the anodes to a source of electrical power.

34 Claims, 8 Drawing Sheets

APPARATUS FOR ELECTRODEPOSITING METAL

FIELD OF THE INVENTION

The present invention relates generally to the art of electrodepositing metal, and more particularly to an apparatus for electroforming metal foils. The present invention is particularly applicable in forming copper foil for use in the manufacture of printed will, of course, be appreciated that the present invention finds advantageous application in electroforming other metal foils and the electrodeposition of metals.

BACKGROUND OF THE INVENTION

The basic technique employed in forming electrodeposited foil has not changed greatly over the years. In this respect, electrodeposited copper foil is generally formed by immersing a rotating drum cathode in an electrolyte solution containing copper ions. An anode formed from one or more arcuate sections of electrically conductive material is immersed in the electrolyte solution are positioned adjacent the drum cathode to define an interelectrode gap therebetween. Copper foil is formed on the rotating drum cathode by applying a current, having a current density lower than the limiting current density of the electrolyte solution, to the anode and cathode. The electrodeposited foil is continually removed from the drum cathode as it emerges from the electrolyte solution so as to permit continuous foil production.

It is well known in the art that several parameters are important in forming deposited foil of high quality and uniform thickness. For instance, maintaining a uniform, accurate spacing between the drum cathode and anode is critical to producing foil. In this respect, if the distance between the anode and cathode varies from one area to another, the cathode current density in the area of greater distance is less which reduces the deposition of metal in that area.

In some instances, a change in the interelectrode gap spacing is a matter of design choice to produce a desired characteristic in the foil produced. For example, U.S. Pat. No. 4,692,221 to Parthasarathi discloses an apparatus having plating regions having different interelectrode gaps operable to produce dendrites on the newly produced foil. To accomplish a similar result (i.e. to effect in situ surface treatment of the metal foil), U.S. Pat. No. 4,898,647 to Luce et al. discloses an apparatus having first and second anodes and a generally uniform interelectrode spacing. The first and second anodes define first and second zones wherein the second zone has a current density greater than the first zone to produce nodules on the foil. Important to both of these devices, as well as other electroforming devices, is that the designed interelectrode spacing remain uniform and constant.

Maintaining uniform spacing between anode and cathode is easier with insoluble anodes since non-uniform dissolution of soluble anodes may occur. Lead anodes are widely used in electroforming metal foils, but while lead anodes are commonly referred to as "insoluble" anodes, they are neither truly insoluble nor permanent. In this respect, in anodic usage, lead dioxide is produced at the surface of the anode and oxygen is liberated from the lead oxide surface rather than at the lead surface. Through continued usage, the lead dioxide is generally dissolved and may flake off thereby increasing the spacing between the anode and cathode and requiring increased voltage to maintain a given current density or total current for the total immersed area.

Another problem related to lead anodes is that their disposal after their useful life is gone. The proper disposal of lead and lead by-products has become a very time-consuming and expensive procedure. To maintain a uniform interelectrode gap, it is, therefore, desirable to utilize an anode material which will not react with the electrolyte solution and preferably one which does not also create the disposal problems associated with lead anodes.

Several metals, such as titanium, stainless steel, chromium, columbium, tantalum, or an alloy thereof, are generally non-reactive with electrolyte fluid and would provide the dimensional stability desired. The materials are, however, relatively poor electrical conductors as compared to lead, and anodes designs known heretofore do not lend themselves to utilization of these materials. In this respect, anode designs known heretofore only exaggerate the relative poor conductive properties of these metals in that many anode designs are generally elongated bars having either flat or curved configuration. If such anodes were formed of the afore-mentioned metals, current distribution along the surface of such bar facing the cathode would be relatively poor as compared to lead.

The present invention overcomes the problem of maintaining an accurate, uniform interelectrode gap in an apparatus for the electrodeposition of metal by providing an anode design capable of utilizing the dimensionally stable metals which are non-reactive with electrolyte solution, and by overcoming the relatively poor electrical conductive properties of such metals, thereby providing electroforming apparatus having and maintaining an exceptionally precise and uniform electrode gap, as well as improved anode service life.

SUMMARY OF THE INVENTION

In accordance with the present invention, there is provided an apparatus for electrodeposition of metal comprising an anode assembly and a moving cathode having a plating surface. The anode assembly and the cathode are spaced apart a predetermined distance to define an interelectrode gap therebetween. The anode assembly is comprised of an anode cradle having a non-conductive surface of a predetermined contour facing the cathode, and a plurality of deformable metallic anodes of general uniform thickness. The anodes have a configuration which nearly conforms to the contour of the anode cradle surface. The deformable anodes are secured to the anode cradle such that the anodes are deformed into mating engagement with the non-conductive surface of the anode cradle to conform to the predetermined contour thereof. Means are provided for connecting the anodes to a source of electrical power.

In accordance with another aspect of the present invention, there is provided an apparatus for producing metal foil, comprising a drum cathode having an outer plating surface, the drum cathode being rotatable about a generally horizontal axis. An anode cradle having a semicylindrical surface of electrically non-conducting material is provided facing the drum cathode, the cradle dimensioned to be spaced from the plating surface of the drum cathode so as to define a generally uniform gap therebetween. A plurality of thin, generally deformable titanium anodes are mounted on the surface of the anode cradle wherein the anodes conform to the contour of the surface thereof. Each of the anodes is individually connectable to a separate source of power. An inlet port formed between two of the anodes is provided for forcing an electrolytic fluid through the inlet port into the gap defined between the drum cathode and anodes.

In accordance with another aspect of the present invention, there is provided an apparatus for electrodeposition of metal comprising a cell containing an electrolyte having a concentration of metal ions to be deposited. A cathode is at least partially immersed in the electrolyte. An anode assembly including an anode carrier having an electrically nonconductive surface is provided facing the cathode wherein the electrolytic fluid is disposed therebetween. The anode carrier forms at least a portion of the call, and includes a plurality of apertures extending therethrough into the call. At least one flexible, generally flat metallic anode having connector means extending to one side thereof is provided. The connector means is connectable to a source of power and dimensioned to be in registry with the apertures in the anode carrier and extend therethrough. Fastener means operable to secure the anode to the carrier are provided to deform the anode wherein the anode assumes the contour of the non-conductive surface of the carrier.

In accordance with another aspect of the present invention, an anode assembly for use with a cylindrical drum is provided. The drum is rotatable about a generally horizontal axis for electrodeposition of metal onto a surface. The anode assembly includes an anode cradle having a semicylindrical, electrically non-conductive surface facing the drum. The cradle is dimensioned to be positioned a predetermined distance below the drum to form an annular gap between the drum and the non-conductive surface. A plurality of elongated, generally rectangular anode plates are disposed completely within the gap about the periphery of the drum. The anode plates are oriented lengthwise generally parallel to the axis of the drum. Mounting means are provided for securing the anode plates to the non-conductive surface of the anode cradle. Connecting means connect the anode plates to sources of electrical power.

In accordance with another aspect of the present invention, there is provided an anode for use with a cylindrical drum which is rotatable about a generally horizontal axis for electrodeposition of metal onto a surface. The anode is a generally elongated, thin metallic plate having a length corresponding to the length of the drum, a width equal to a predetermined circumferential portion of the drum, and a thickness which permits the plate to be deformed a limited amount. The anode is formed to have a side-to-side radius of curvature greater than the radius of curvature of the drum. A plurality of mounting pins for mounting the plates adjacent the drum extend from one side of the plates.

It is an object of the present invention to provide an apparatus for electrodepositing metal onto a surface.

Another object of the present invention is to provide a device as defined above which finds advantageous application in electroforming metal foil or in electrodepositing metal on existing metal.

Another object of the present invention is to provide an apparatus as defined above having a rotating drum and an anode assembly disposed about the circumference of the drum, wherein the gap between the drum and anode assembly is extremely accurate and uniform and remains uniform even after prolonged use.

Another object of the present invention is to provide an apparatus as defined above having a plurality of anodes, each of which may be individually connected to a separate power supply.

Another object of the present invention is to provide an apparatus as defined above including an anode which assembly is comprised of a plurality of thin, deformable metallic stripe which are dimensioned to conform to the shape of a support surface.

A still further object of the present invention is to provide a dimensionally stable anode (DSA) for use in electrodeposition of metal.

Another object of the present invention is to provide an anode as defined above, wherein such anode is dimensionally stable and provides longer service life and requires less maintenance.

A still further object of the present invention is to provide an anode as defined above which does not react with an electrolyte solution.

A still further object of the present invention is to provide an anode as defined above which is formed of titanium or other non-reactive metal material, which provides sufficient current density when applied to a power source.

A still further object of the present invention is to provide an apparatus for electrodepositing metal which apparatus enables greater control and monitoring of the electrolyte in the interelectrode gap.

A still further object of the present invention is to provide an anode design capable of utilizing metals which are less environmentally harmful than lead.

These and other objects and advantages will become apparent from the following description of a preferred embodiment of the present invention taken together with the accompanying drawings.

DESCRIPTION OF THE DRAWINGS

The invention may take physical form in certain parts and arrangement of parts, a preferred embodiment to which will be described in the specification and illustrated in the accompanying drawings which form a part hereof and wherein.

DETAILED DESCRIPTION OF THE PREFERRED EMBODIMENT

Figure 1:
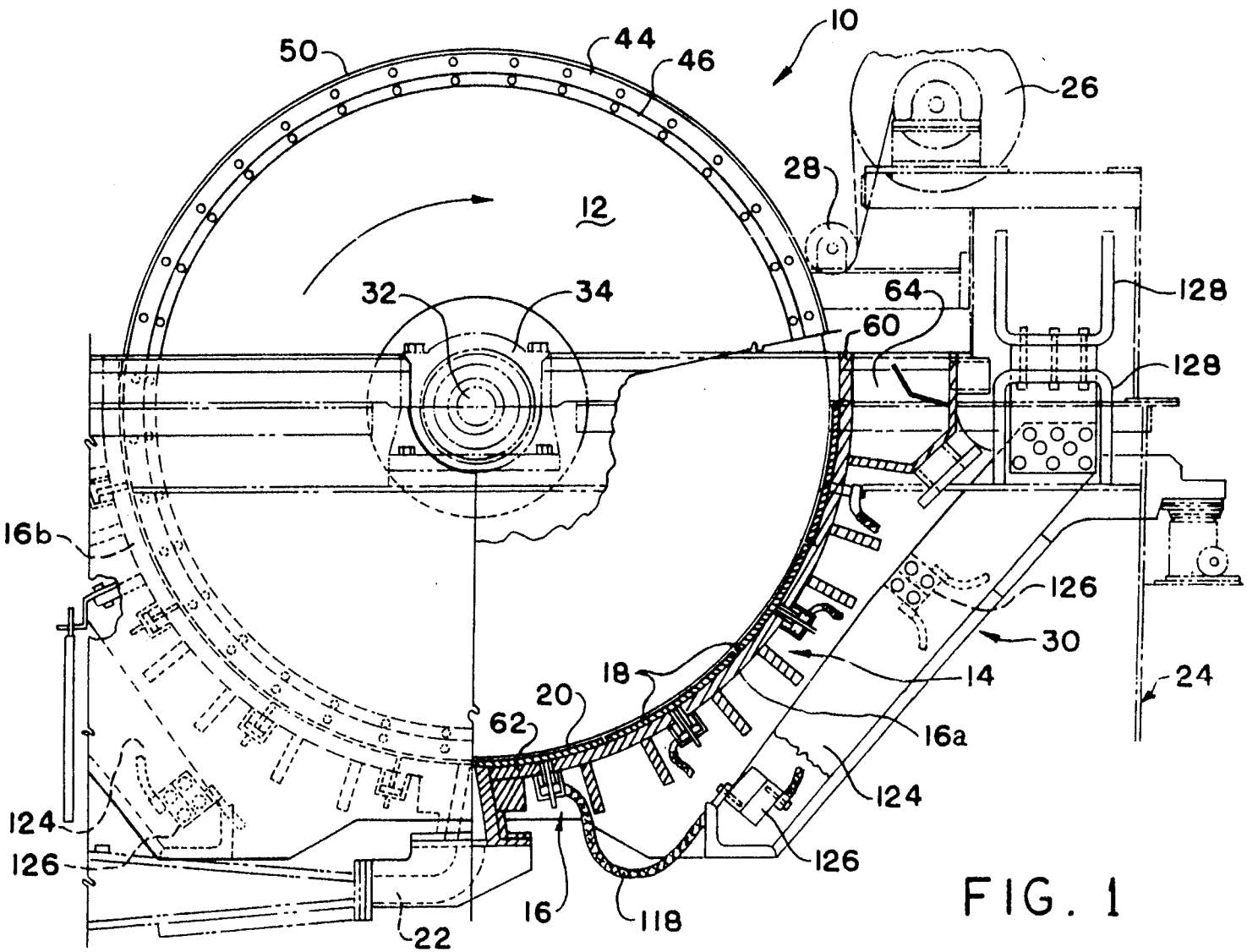
FIG. 1 is an end, partially sectioned, elevational view of an apparatus for an electroforming copper foil illustrating a preferred embodiment of the present invention.

Referring now to the drawings wherein the showings are for the purpose of illustrating the preferred embodiment of the invention only and not for the purpose of limiting same. FIG. 1 shows an electroforming apparatus 10 for electroforming metallic foil, illustrating a preferred embodiment of the present invention. The present invention is particularly applicable for forming copper foil and will be described with reference thereto, although it will be appreciated that the invention applications in forming other metallic foils or for electrodeposition metal on an existing metal surface.

Broadly stated, electroforming apparatus 10 is generally comprised of a drum cathode 12 and an anode assembly, designated 14 in the drawings. Anode assembly 14 includes an anode cradle 16 and plurality of anodes 18 secured thereto. Anode assembly 14 is disposed beneath drum cathode 12 and is dimensioned to be positioned a predetermined distance therefrom wherein anodes 18 are circumjacent at a uniform distance to drum cathode 12 to define an annular space or gap 20 therebetween. An electrolyte supply conduit 22 is provided at the lower-most portion of the anode assembly 14 to supply electrolyte fluid into gap 20. Importantly, according to the present invention, anode assembly is operable to confine the electrolyte fluid in gap 20. In other words, in addition to supporting and positioning anodes 18 adjacent drum cathode 12, anode assembly 14 is essentially a tank for holding the electrolyte solution. To this end, anode assembly 14 is dimensioned such that approximately half of drum cathode 12 is immersed in the electrolyte solution in gap 20. A housing 24 (shown in phantom in FIG. 1) is provided as a mounting platform for drum cathode 12, anode assembly 14 and other components of electroforming apparatus 10. Housing 20 supports a take-up roller 26 onto which the electroformed metal foil produced by electroforming apparatus 10 is wound and an intermediate tension roller 28. An electrical power distribution network 30 is enclosed within housing 24 to provide a source of power to drum 12 and anode assembly 14, in a manner which shall be described in greater detail below.

Drum cathode 12 is generally cylindrical in shape and mounted to housing 24 by suitable conventional means for rotation about a generally horizontal axis. In the embodiment shown, drum cathode 12 is rotatable on a shaft 32 which is supported at its distal ends by pillow block bearings 34 (shown in phantom in FIGS. 1 and 2), which bearings 34 are secured to a horizontal surface on housing 24. Drum cathode 12 may be formed from any suitable electrically-conductive metal or metal alloy including lead, stainless steel, columbium, tantalum, titanium, or an alloy thereof. According to the present invention, drum cathode 12 is preferably comprised of a stainless steel drum having a polished plating surface 36. The plating surface may be formed from titanium, chromium, columbium, tantalum, or an alloy thereof. Drum cathode 12 may be rotated by any suitable motor drive arrangement (not shown) known in the art. Cathode drum 12 is preferably rotated at a circumferential speed which permits plating surface 36 to remain in contact with the electrolyte fluid in gap 20 for a sufficient period of time to develop the desired foil thickness.

Figure 7:
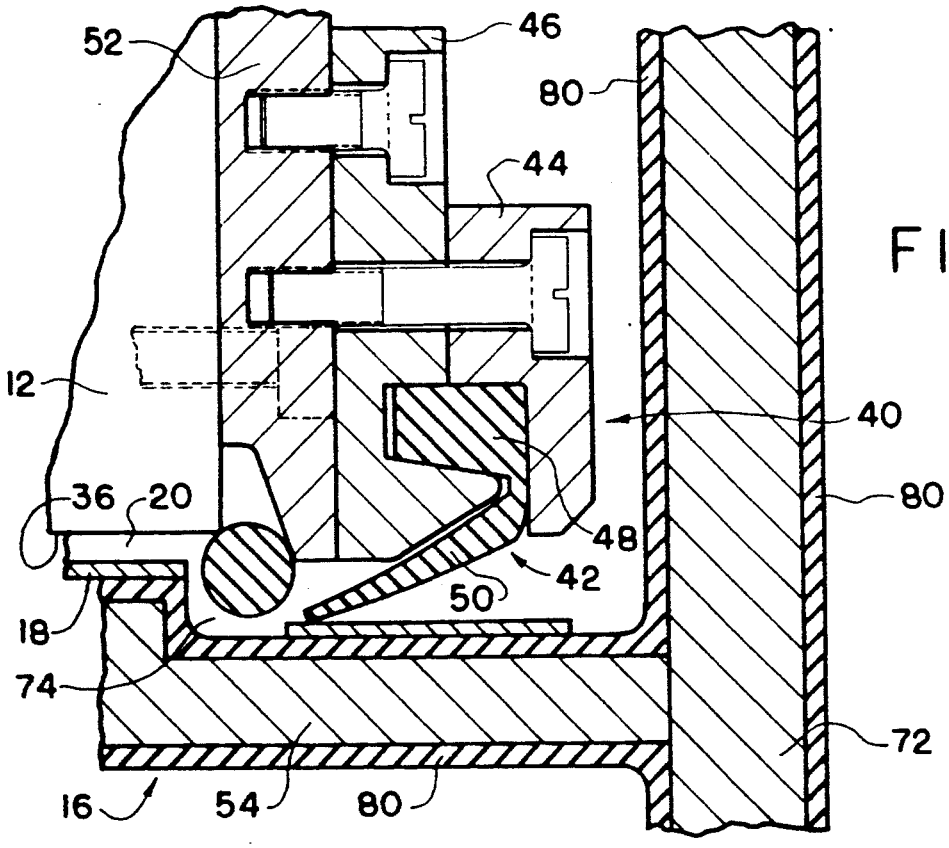
FIG. 7 is an enlarged, sectional view taken along line 7—7 of FIG. 2.

A seal arrangement 40, shown in FIG. 7, is provided at the ends of drum cathode 12. Seal arrangement 40 is generally comprised of a seal element 42 disposed between annular rings 44, 46. Seal element 42 includes a generally rectangular portion 48 which is confined between rings 44, 46 and an outward extending arm 50 which is dimensioned to extend beyond plating surface 36 of drum cathode 12. Outer ring 44 is fastened by conventional fasteners to inner ring 46 to support and confine seal element 42 therebetween. Inner ring 46 is secured to end plate 52 of drum cathode 12 by conventionally known fasteners.

Figure 2:
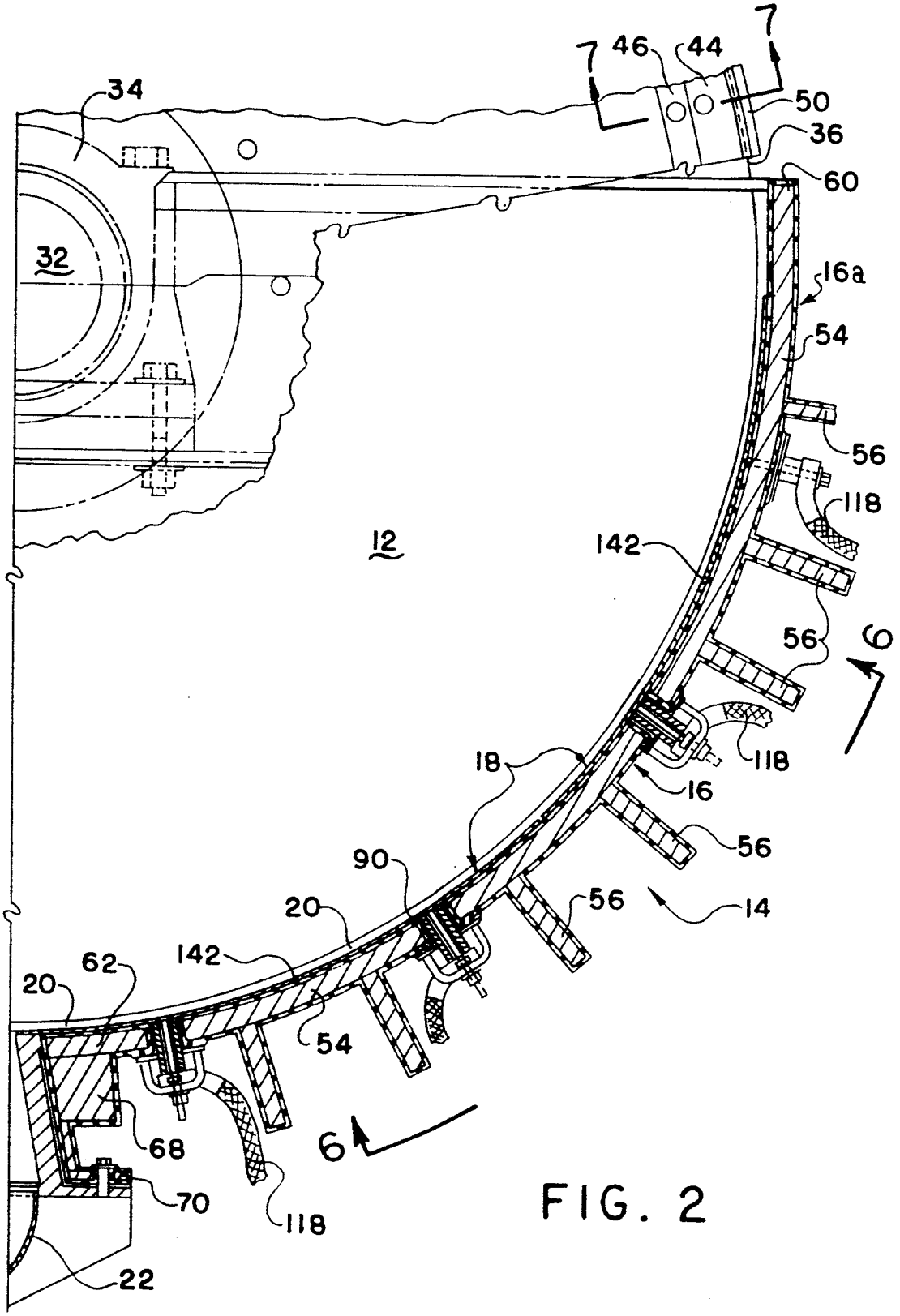
FIG. 2 is an enlarged, sectional view of a portion of the apparatus shown in FIG. 1 showing a cathode-anode cell illustrating another aspect of the present invention.
Figure 12:
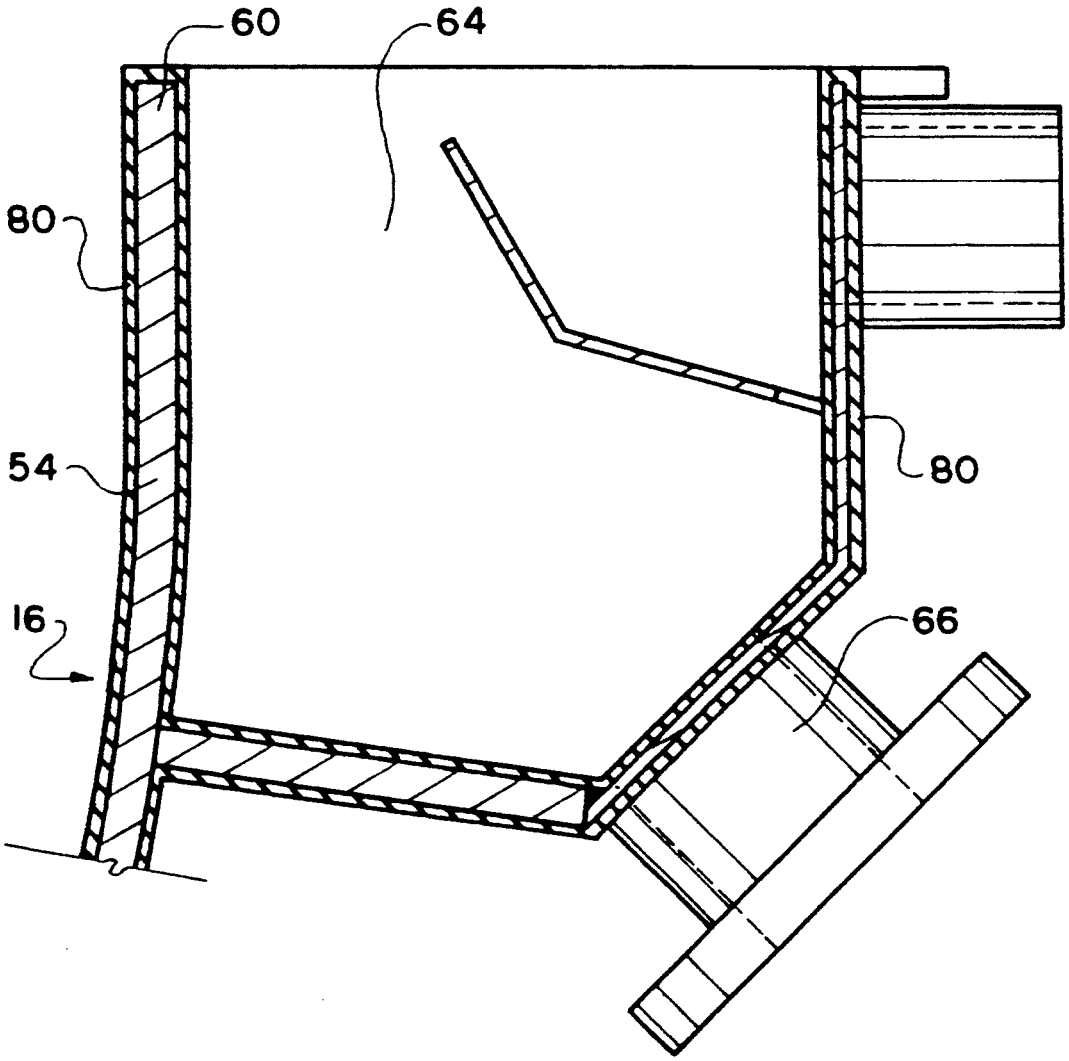

Referring now to FIG. 2, as indicated above, anode assembly 14 is comprised of anode cradle 16 and a plurality of elongated, generally rectangular anodes 18. Anode cradle 16 is generally a semi-cylindrical tank dimensioned to receive cathode drum 12. In this respect, anode cradle 16 is comprised essentially of two (2) cradle sections, designated 16A, 16B in the drawings. Sections 16A, 16B are generally mirror images of each other and, therefore, only one section will be described in detail; it being understood that such description applies equally to the other. Anode cradle section 16A, best seen in FIG. 2, is generally comprised of a curved structural plate 54 and a plurality of reinforcing ribs 56 secured thereto. Plate 54 is preferably formed to have a radius of curvature generally conforming to the radius of curvature of plating surface 36 of drum anode 12. Ribs 56 extend radially outwardly from plate 54 and extend longitudinally from end-to-end of section 16A. Plate 54 includes an upper edge 60 and a lower edge 62. A generally rectangular trough 64 (best seen in FIG. 12) extends outwardly from plate 54 near upper edge 60 thereof. Trough 64 is fixedly secured to plate 54 and extends from one end of anode cradle 16 to the other. Trough 64 is dimensioned to collect electrolyte fluid from gap 20 which overflows upper edge 60. To this end, trough 64 includes drain port 66 connectable to an electrolytic fluid reservoir (not shown) to collect overflowing fluid. Lower edge 62 of anode cradle plate 54 includes a mounting structure 68 comprised of a plurality of structural members secured together. Mounting structure 68 includes a mounting pad 70 for use in attaching anode cradle 16 to electrolytic supply conduit 22. To complete the tank, each end of cradle plate 54 is secured to a generally vertical end plate 72, as best seen in FIG. 7. As illustrated in FIG. 7, the ends of curved cradle plate 54, where it attaches to end plate 72, includes a recessed portion 74 to accommodate seal element 42 mounted at each end of drum cathode 12. Together, plates 54 of anode cradle sections 16A, 16B, and end plates 72 form a semi-cylindrical tank, which, as indicated above, is dimensioned to receive drum cathode 12 therein. In this respect, the tank formed by the curved plates 54 and end plates 72 is generally symmetrical about the axis of drum cathode 12.

In accordance with the present invention, curved cradle plate 54 includes a plurality of elongated slots 76 (best seen in FIG. 8) which extend generally from one end of plate 54 to the other. Slots 76 are provided for mounting anodes 18 to anode cradle 16 and are disposed in plate 54 to extend in a direction generally parallel to the axis of drum cathode 12. In this respect, slots 76 are parallel to each other and are preferably equally spaced-apart between upper edge 60 and lower edge 62 of cradle plate 54.

The components forming anode cradle 16 heretofore described are preferably formed of metal and are preferably fastened into an integral structure. In the embodiment shown, the respective components are formed of hot rolled steel plate and welded together by conventional welding techniques.

In accordance with the present invention, the entire outer surface of the metal anode cradle structure is covered by a layer 80 of a hard, electrically non-conductive material. In the embodiment shown, layer 80 is comprised of semi-hard (90–97 Durometer hardness) rubber having a thickness which varies between ⅛ inch to 3/16 inch. As will be appreciated, a purpose of the rubber coating is to protect the steel cradle weldment from the acidic electrolytic solution.

Importantly, layer 80 on the inner, concave side of anode cradle 16, i.e. the side of anode cradle 16 facing drum cathode 12, is preferably machined to provide a smooth, cylindrical mounting surface 82 for mounting anodes 18. In this respect, layer 80 on the inner side of anode cradle 16 is preferably machined by a cutting tool (not shown) rotated about the axis of drum cathode 12 to provide a cylindrical mounting surface 82 as true and accurate as possible. By machining mounting surface 82 in such a manner, the annular spacing defined between mounting surface 82 and plating surface 36 on drum cathode 12 is extremely accurate and uniform.

Figure 8:
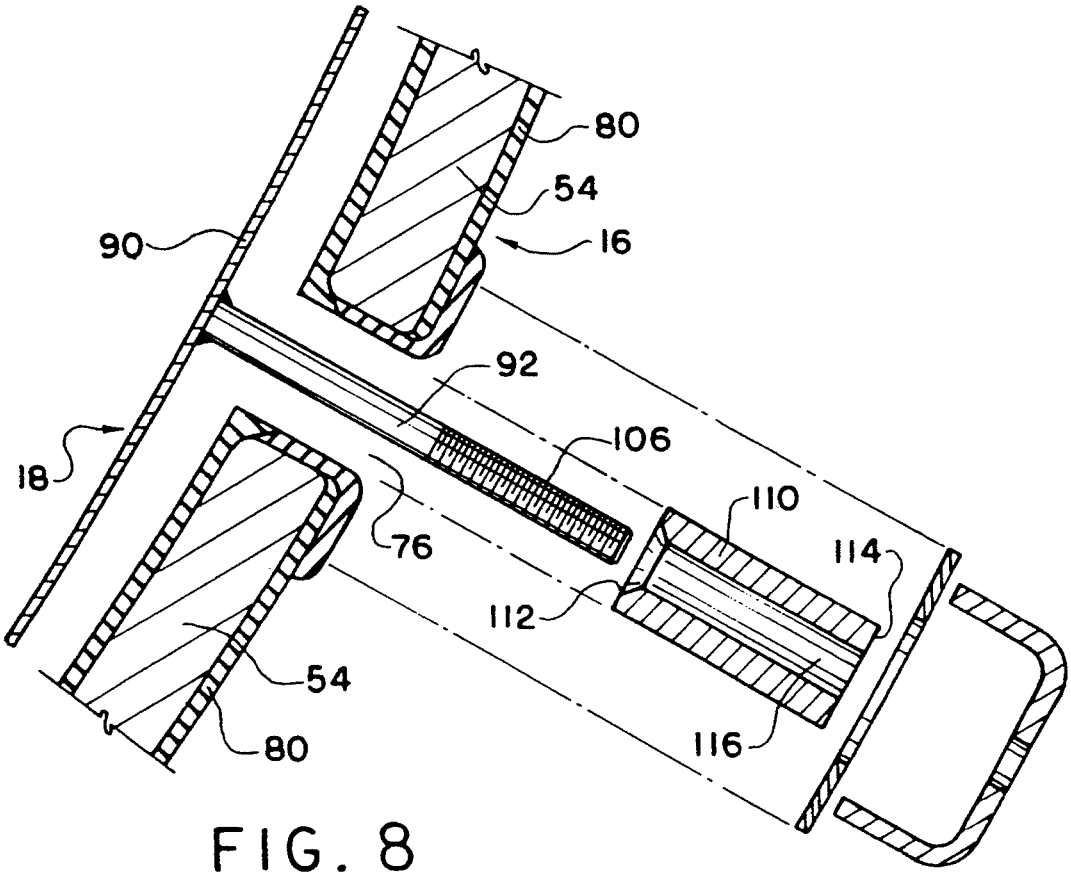
FIGS. 8 and 9 are enlarge, sectional views illustrating the manner in which an anode segment is mounted to the apparatus.
Figure 9:
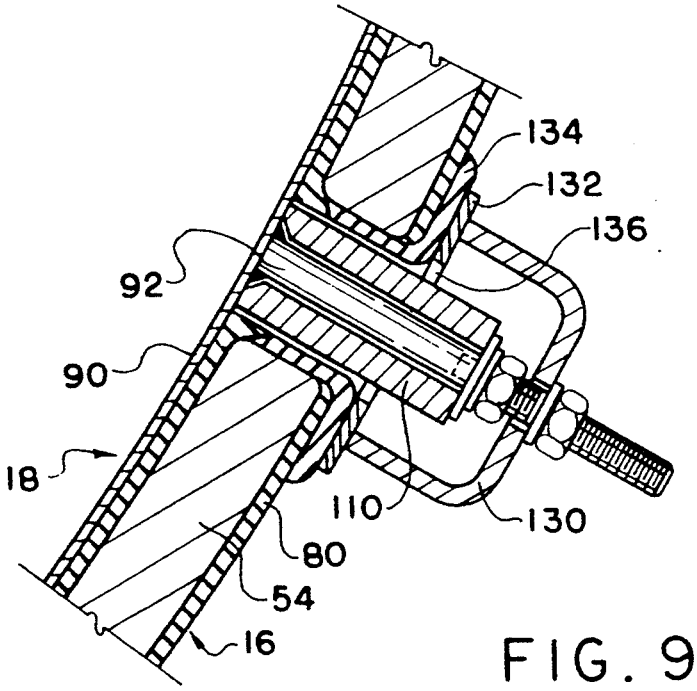
Figure 10:
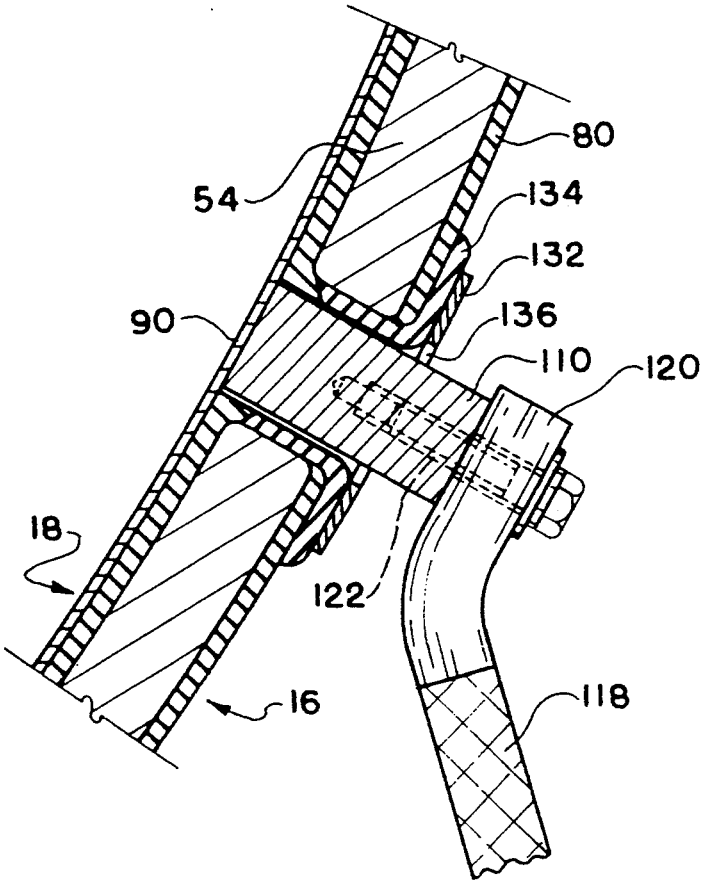
FIG. 10 is an enlarged, sectional view of an electrical connector mounted to an anode segment.

Mounted to anode cradle 16 are a plurality of elongated, generally rectangular anodes 18. As shown in FIG. 8–10, anodes 18 are generally comprised of an anode plate 90 having a plurality of aligned, spaced-apart mounting pins 92 secured to one side thereof. Mounting pins 92 are aligned along plate 90 and disposed thereon to be received within slots 76 in anode cradle 16.

Figure 3:
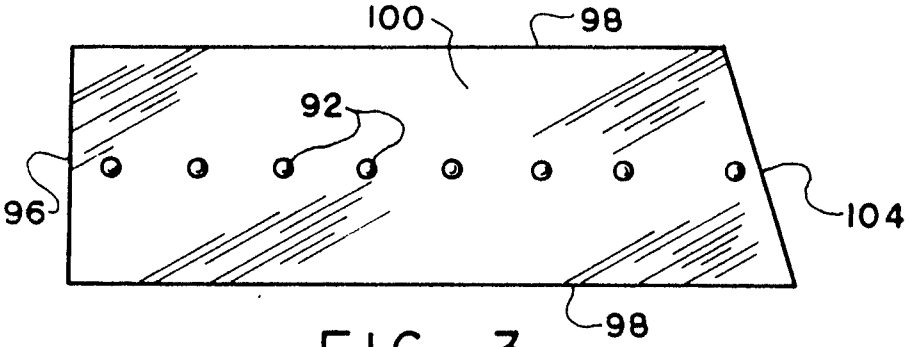
FIG. 3 is an enlarged, plan view of an anode segment used in the apparatus shown in FIG. 1.
Figure 4:
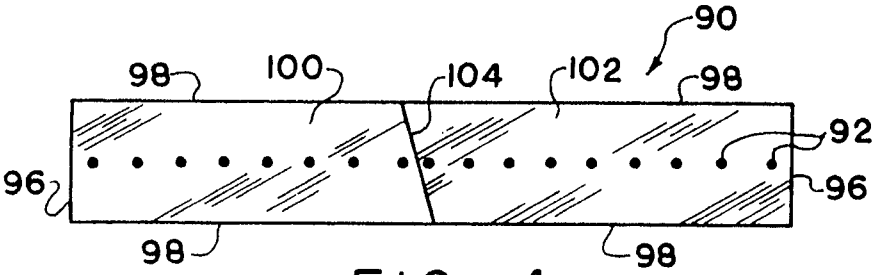
FIG. 4 is a plan view of two anode segments forming an anode plate used in the apparatus shown in FIG. 1.

Anode plates 90 are basically thin, rectangular plates of electrically conductive material having straight, longitudinal ends 96 and lateral edges 98, as shown in FIGS. 3 and 4. In the embodiment shown, anode plate 90 is formed from two aligned anode segments 100, 102 which abut along a mating line 104. Anode plate 90 is preferably formed as one continuous piece, but may be formed in segments, as shown, to facilitate, forming, coating, or assembly depending upon the size of apparatus 10 and plates 90 themselves. Anode plates 90 may be formed from any suitable electrically conductive metal known in the art, such as lead or alloys thereof, but is preferably formed of metals which are truly dimensionally stable in electrolytic fluids and do not create the environmental problems associated with lead or lead alloy materials. In this respect, anode plates 90 may be formed from titanium, chromium, columbium, tantalum, platinum, stainless steel, or an alloy thereof. In the embodiment shown, anode plates 90 are formed of titanium.

Figure 5A:
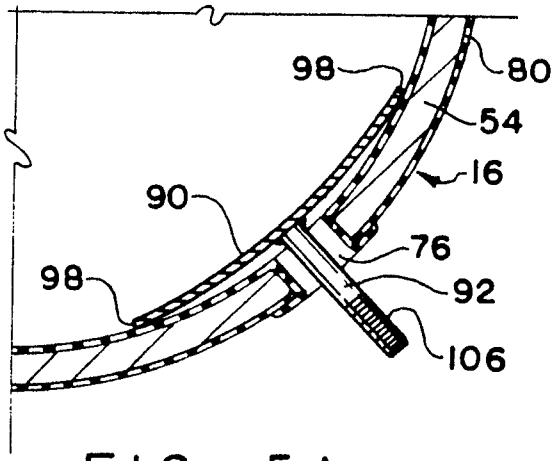
FIGS. 5A and 5B are cross-sectional views illustrating, in an exaggerated showing, the manner in which the anode segments are mounted in the apparatus shown in FIG. 1.
Figure 5B:
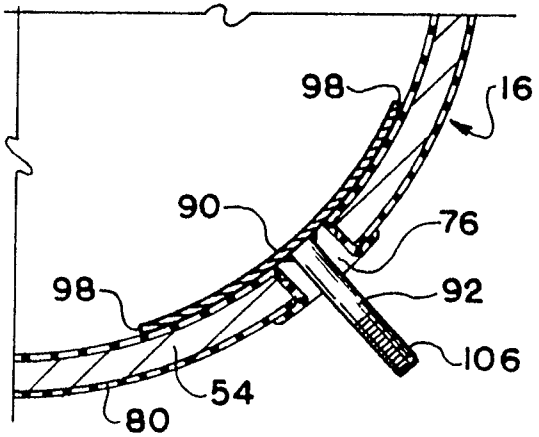

According to the present invention, anode plate 90 has a slight, lateral edge-to-edge curved profile. In this respect, anode plate 90 has an edge-to-edge radius of curvature slightly greater than the radius of curvature of mounting surface 82 of anode cradle 16. In other words, if anode plate 90 is laid lengthwise on mounting surface 82 such that anode plate 90 extends generally parallel to the axis thereof, anode plate 90 would rest on mounting surface 82 on lateral edges 98, as shown in FIG. 5A. In FIG. 5A, the difference between the radiuses of curvature of anode plate 90 and surface 82 has been exaggerated for the purpose of illustration. Anode plate 90 has a uniform, predetermined thickness. In this respect, the radius of curvature of anode plate 90 and the thickness thereof are generally related to the physical properties of the material forming the plate 90. As will be appreciated from a further reading of this description of a preferred embodiment, anode plate 90 preferably has a thickness wherein anode plate 90 is deformable to a limited extent when subject to an applied force along the axis of mounting pins 92.

Mounting pins 92 are generally cylindrical in shape and are secured to the convex side of anode plate 90 and extend generally perpendicular thereto. Mounting pins 92 are formed of a suitable electrically conductive material and fixedly secured to anode plate 90 in a manner enabling electrical conduction therewith. In the embodiment shown, mounting pins are formed of the same metallic material forming anode plate 90, i.e. titanium, and are welded thereto. Mounting pins 92 are dimensioned to extend through slots 76 in anode cradle 16. The free ends of mounting pins 92 include a threaded portion 106.

Figure 6:
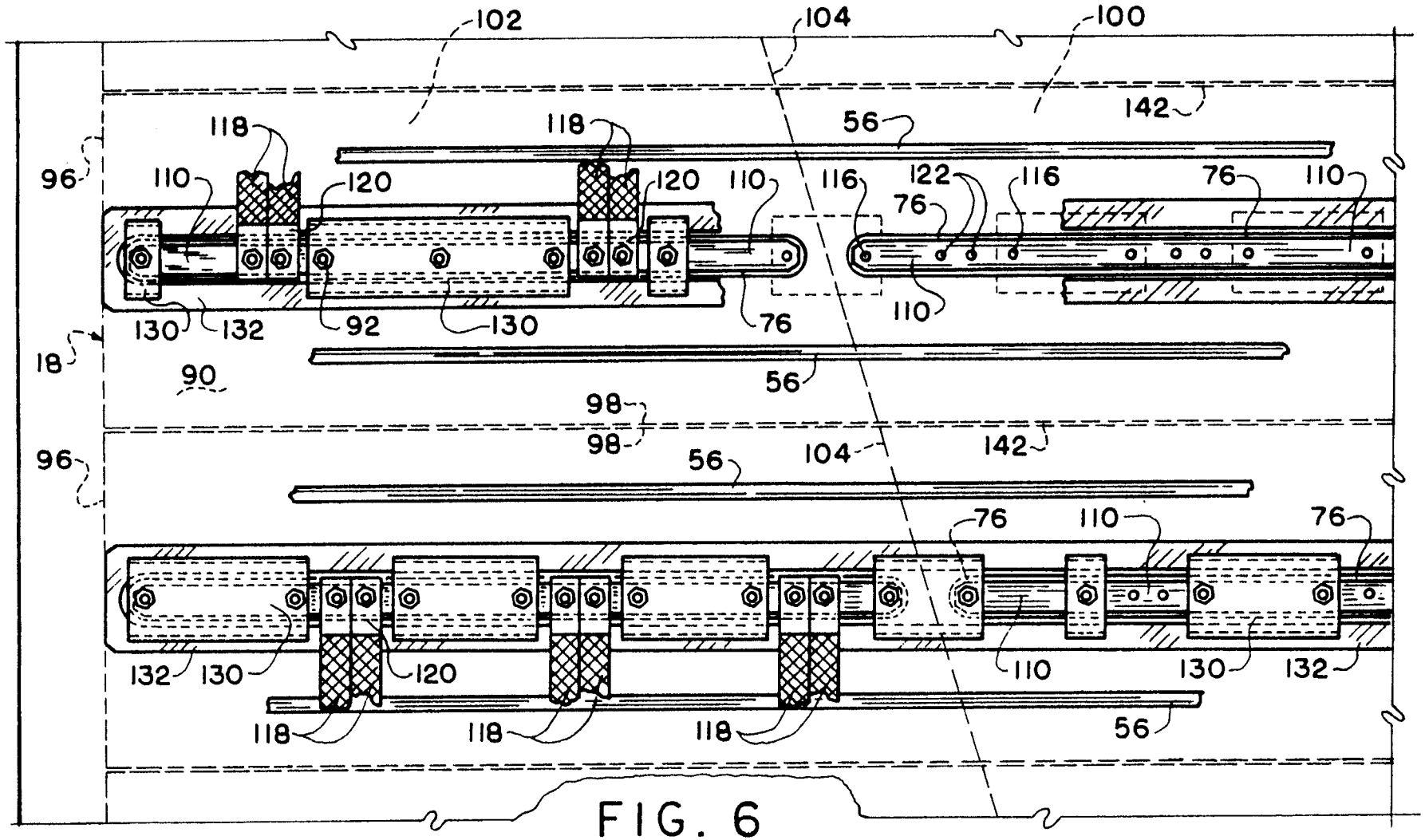
FIG. 6 is view taken along line 6—6 of FIG. 2.

Referring now to FIGS. 6 and 8–10, a connector bar 110, formed from an electrically conductive material, is attached to each anode 18 to connect anode 18 to a source of electrical power. Connector bar 110 is preferably formed of copper or an alloy thereof. Connector bar 110 is dimensioned to be secured to anode 18 and to be received in slots 76 of anode cradle 16. To this end, connector bar 110 is an elongated bar with a generally rectangular cross-section having a first edge and a second edge 114, wherein edge 112 is formed to be in electrically conductive contact with the convex side of anode plate and a second edge 114. To facilitate good electrical contact between anode plate 90 and connector bar 110, edge 112 of connector bar is preferably formed to have a radius of curvature which is the same as the radius of curvature of anode plate 90 when anode plate 90 is mounted to anode cradle 16. In other words, edge 112 has a radius of curvature generally equal to the radius of curvature of mounting surface 82. To enhance the electrical connection between anode plate 90 and connector bar 110, edge 112 of connector bar 110 or the convex surface of anode plate 90 may be plated with gold, silver, or platinum. Connector bar 110 includes a plurality of apertures 116 which are positioned therealong to be in registry with mounting pits 92 on anode 18. Apertures 116 are dimensioned to receive mounting pins 92 therein and, to this end, aperture 116 may be countersunk or counterbored along edge 112 to accommodate the welded area where mounting pin 92 is joined to anode plate 90, as shown in FIGS. 6 and 7. Connector bar 110 is attached to anode 18 by means of a conventional washer and threaded fastener, as shown in FIG. 7.

Connector bar 110 is connected to an electrical power source by means of one or more electrical cables 118 secured to edge 114 of connector bar 110, as shown in. FIG. 10. Electrical cable 118 includes a mounting lug 120 which is secured to connector bar 110 by means of a conventionally threaded fastener extending through mounting lug 120 into a threaded aperture 122 (shown in phantom in FIG. 10). One or more electrical cables 120 may be disposed along connector bar 110, as shown in FIG. 6. When more than one electrical cable 118 is mounted to connector bar 110, such cable 118 is preferably spaced along connector bar 110 to uniformly and evenly distribute current to anode plate 90. Electrical cable 118 provide power to connector bars 110 from power distribution network 30 shown in FIG. 1.

In the embodiment shown, power distribution network 30 is a grid-like assembly comprised of a plurality of main bus bars 124 connected by bus bar cross members 126 which extend therebetween. The upper end of main bus bars 124 are connected to U-shaped bus bar connectors 128 which are, in turn, connected to a power source (not shown). The arrangement of power distribution network 30 in and of itself is not critical to the present invention, it only being important that network 30 have sufficient current-carrying capacity to meet the power and distribution requirements of apparatus 10.

Anode 18 and connector bar 110 are secured to anode cradle 16 by means of one or more clamps 130 and spacers 132, best seen in FIGS. 6 and 7. An elevated pad 134 formed of the material covering anode cradle 16 is formed along the sides of slots 76 in anode cradle 16. Each spacer 132 is a generally thin flat metallic plate dimensioned to be positioned against pad 134, and has an elongated opening 136 dimensioned to correspond to slot 76 in cradle 16 and to receive connector bar 110 therethrough. In the embodiment shown, clamps 130 are generally U-shaped and come in several lengths having one or more apertures 138 therein to receive one or more mounting pins 92 therethrough. A conventional, threaded fastener and washer are provided on threaded portion 106 of mounting pin 92 to secure anode 18 to anode cradle 16, as shown in FIG. 9. In this respect, because anode plate 90 has a radius of curvature greater than the radius of curvature of mounting surface 82, tightening of the fastener on threaded portion 106 of mounting pin 92 causes anode plate 90 to deform, wherein it generally conforms to the contour of mounting surface 82. To ensure a liquid fluid-tight seal between anode plates 90 and mounting surface 82, the underside of plate 90 is preferably coated with a sealant material. In the embodiment shown, a thin, uniform layer (approximately 1/32 inches) of pure silicon adhesive is used.

Importantly, because anode plates 90 each have a predetermined, uniform thickness, when mounted to mounting surface 82, anodes 18 together define with plating surface 36 of drum cathode 12 an extremely precise annular interelectrode gap 20 of known dimension. In accordance with the present invention, anodes 18 are preferably dimensioned to substantially cover mounting surface 82 of anode cradle 16. Importantly, lateral edges 98 of adjacent anode plates 90 are close, but not in contact with each other. In this respect, a small gap 142 is defined between the lateral edges 98 of adjacent anode plates 90, as seen in FIGS. 2 and 6. As indicated above, slots 76 in anode cradle 16 are aligned and extend parallel to the axis of drum cathode 12. Consequently, anode plates 90 are aligned generally parallel to the axis of drum cathode 12.

Figure 11:
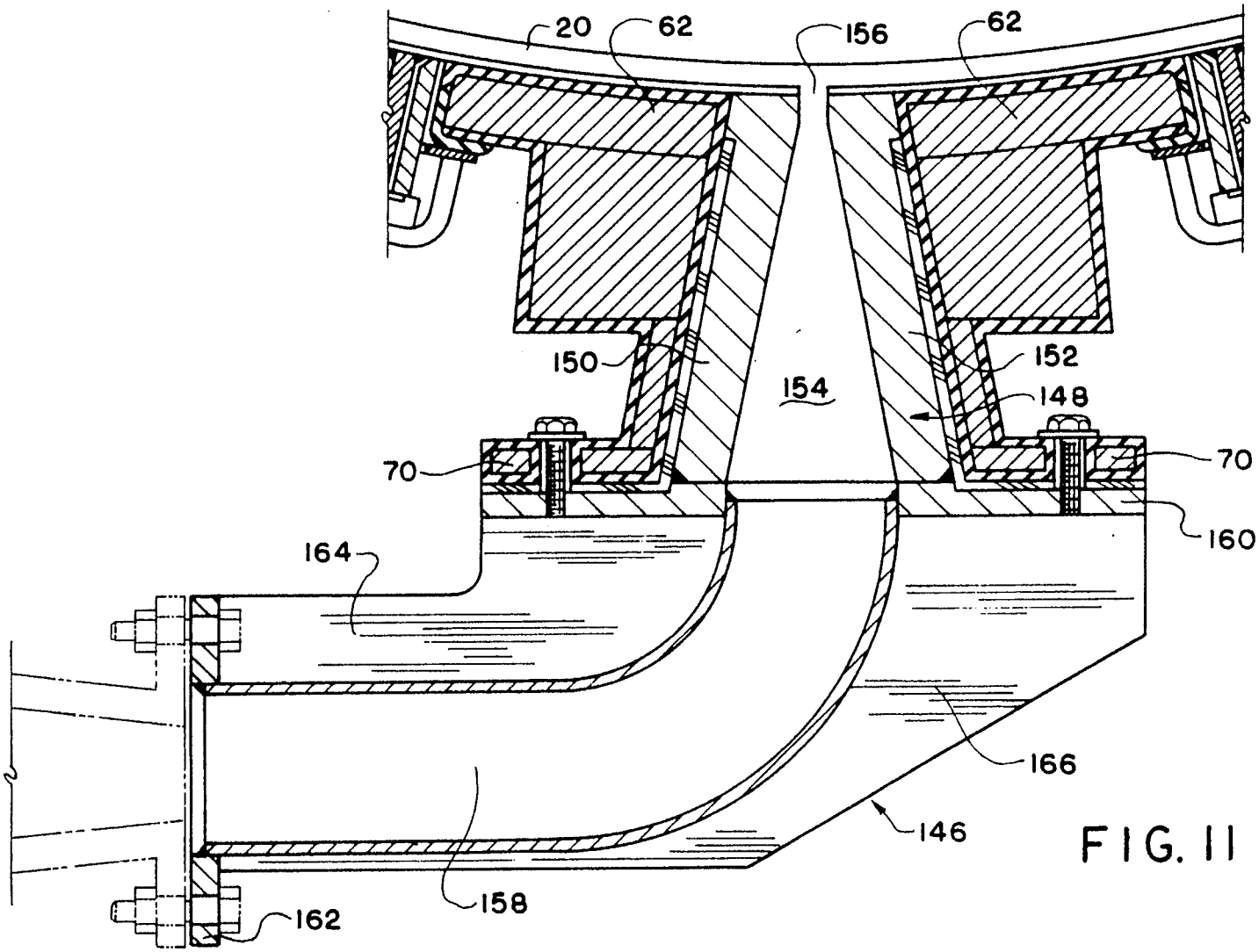
FIG. 11 is an enlarged, sectional view showing an electrolyte supply conduit; and, FIG. 12 is an enlarged, sectional view of an electrolyte solution overflow trough.

Referring now to FIG. 11, electrolyte supply conduit 22 is shown. Conduit 22 is generally comprised of a duct assembly 146 and a nozzle 148. Nozzle 148 includes side-by-side inclined plates 150, 152, which are positioned between the lower edges 62 of anode cradle sections 16A, 16B. Plates 150, 152 preferably formed of a non-corrosive material such as titanium. Plates 150, 152 define a wedge-shaped cavity 154 having an inlet port 156 communicating with gap 20 at the upper end thereof. Inlet port 156 extends generally the entire length of drum cathode 12.

Duct assembly 146 is generally comprised of a duct 158, which has a rectangular cross-section, and extends between mounting flanges 160, 162. Pairs of reinforcing plates 164, 166 are provided along duct 158 to provide structural support to same. First mounting flange 160 is fastened to pads 70 of anode cradle 16 by means of conventional fasteners. Second mounting flange 162 is connected to an electrolytic fluid feed pipe (shown in phantom in FIG. 11) which, in turn, is connectable to an electrolytic fluid reservoir and pump (not shown) which is operable to force electrolytic fluid into annular gap 20.

Referring now to the operation of apparatus 10, each anode 18 is connected to a power supply via power distribution network 30. Any suitable power supply known in the art may be used. As indicated above, in the embodiment shown, anodes 18 are formed of titanium which is a relatively poor conductor of electricity. This problem is overcome by the present invention which provides thin plates having a plurality of spaced-apart electrical connections thereon. The multiple electrical connections on the anode provide sufficient distribution along the plate to overcome the inherent poor electrical properties of titanium. At the same time, the dimensional stability of anodes 18, resulting from the nonreactive properties of titanium, together with the accurate positioning of the anode plates 90 circumjacent drum cathode 12, resulting from being mounted on a machine cylindrical surface, provides an extremely uniform interelectrode gap 20 which maintains its uniformity even after extensive use.

During operation of apparatus 10, electrolytic fluid is continuously pumped from a reservoir (not shown) into interelectrode gap 20 between anodes 18 and the rotating drum cathode 12 at a controlled rate. As a result of the current applied to anodes 18, metal from the electrolyte is deposited on plating surface 36 of drum cathode 12. The electrolyte solution is pumped in gap 20 from electrolyte supply conduit 22 and collected by troughs 64 when it overflows upper edges 60 of anode cradle 16. The formed metal foil may be removed from the drum cathode 12 in any suitable manner known in the art. For example, a knife blade (not shown) may be used to strip the treated foil from the drum cathode, wherein it may be wound onto take-up roll 26.

Importantly, apparatus 10 permits greater monitoring and control of the parameters affecting the foil formation. Gap 20 is basically defined between anodes 18, plating surface 32, drum cathode 12, and seal elements 42 provided at the end of drum cathode 12. In this respect, a predetermined identifiable space of known volume is defined. By monitoring the concentration of the electrolyte fluid as well as the flow of such fluid through gap 20, the foil forming process can be monitored and controlled to optimize foil production. Specifically, predetermined flow rate of electrolyte fluid having known concentrations of ions therein can be established in relation to the current levels established on anodes 18 and rotation of drum cathode 12.

While the invention has been described as having a plurality of anodes each of which is charged by a common power supply, each anode may be connected to a separate power supply to establish various current densities along the path of drum cathode 12. For example, selected anodes may have a base current density below the limiting current density to provide a relatively smooth metal deposit having a uniform thickness on plating surface 36, while subsequent anodes (in the direction of drum cathode 12) may have a second current applied by a separate power source sufficient to generate a second current density greater than the limiting current density wherein nodules or dendrites may be formed on the copper foil. It will thus be appreciated that the present apparatus provides not only greater monitoring and control of the parameters affecting creation of metal foil, but also provides flexibility in the treatment of such foil.

It should also be appreciated that although the present invention has been described with respect to electroforming metallic foils, the anode structure disclosed by the present invention is applicable in treating, i.e. depositing subsequent metal layers, on existing metal foils.

Accordingly, while the present invention has been described with respect to a preferred embodiment, modifications and alterations will occur to others upon their reading and understanding of the specification. It is intended that all such modifications and alterations be included in so far as they come within the scope of the patent as claimed or the equivalence thereof.

Having described the invention, the following is claimed:

1. An apparatus for producing metal foil comprising:

tank means having a semi-cylindrical inner surface for holding an electrolytic solution;

an electrically non-conductive lining mounted to said inner surface of said tank;

a cathode drum having a plating surface mounted within said tank defining a generally uniform gap between said plating surface of said drum and said lining of said tank;

a plurality of generally rigid yet deformable metallic anode plates having mounting means extending from one side thereof, said anodes mounted on said non-conductive lining of said tank with said mounting means extending through said tank means:

connecting means attached to said mounting means for securing said anodes to said tank wherein said anodes conform to the contour of said lining and form a fluid-tight seal therewith, each of said anodes being spaced apart from an adjacent anode and positioned a uniform distance from said cathode drum;

means for connecting said mounting means to one or more separate sources of power; and means for introducing electrolytic solution into said gap.

2. An apparatus as defined in claim 1 wherein said anodes are elongated, generally rectangular plates of metal extending generally parallel to said drum.

3. An apparatus as defined in claim 2 wherein said anodes are connectable to sources of power at several locations along the length of said strip.

4. An apparatus as defined in claim 1 wherein said mounting means are pins secured to said anode plates.

5. An apparatus as defined in claim 1 wherein said anodes are elongated, generally rectangular metal plates having a normal, side-to-side radius of curvature greater than the radius of said inner surface of said tank.

6. An apparatus as defined in claim 5 wherein:

said anodes include a plurality of mounting pins extending from one side of said plates, and said tank is comprised of a curved plate having at least one aperture therethrough dimensioned to receive said mounting pins.

7. An apparatus as defined in claim 1 further comprising receptacle means disposed at the ends of said gap operable to receive excess electrolytic fluid from said gap.

8. An apparatus for producing metal foil, comprising:

a cathode drum having an outer plating surface, said drum being rotatable about a generally horizontal axis;

an anode cradle having a semi-cylindrical upper surface of electrically non-conducting material facing said cathode drum and a lower surface facing away from said cathode drum, said cradle dimensioned to be spaced from the plating surface of said cathode drum so as to define a generally uniform gap therebetween;

a plurality of thin, generally deformable titanium anodes, mounting means extending through said anode cradle for mounting said anodes to said upper surface wherein said anodes conform to the contour of said upper surface and form a fluid-tight seal therewith, said mounting means being connectable to one or more separate sources of power;

an inlet port formed between two of said anodes; and, means for forcing an electrolytic fluid through said inlet port into said gap.

9. An apparatus as defined in claim 8 wherein:

said anode cradle is generally comprised of a curved metal plate which is coated with a non-conductive material, and said anode includes mounting pins which extend through said anode cradle.

10. An apparatus as defined in claim 8 further comprising overflow means for receiving excess electrolytic fluid from said gap.

11. An apparatus as defined in claim 8 wherein said anodes are generally rectangular, thin plates extending longitudinally generally parallel to said drum, each of said plates being connectable to a source of power at several locations along the length of said plates.

12. An apparatus as defined in claim 11 wherein said plates have a normal, side-to-side radius of curvature greater than the radius of curvature of said semi-cylindrical of said anode cradle.

13. An apparatus as defined in claim 8 wherein said anode cradle is generally a flat, metallic plate formed into a semi-cylindrical shape having a generally uniform, electrically non-conductive lining covering the exterior thereof.

14. An apparatus for electrodeposition of metal comprising:

an anode and a moving cathode having a plating surface, said anode and said cathode being spaced apart and defining an interelectrode gap therebetween;

said anode comprised of:

an anode cradle having a non-conductive surface of predetermined contour facing said cathode;

a plurality of deformable metal elements of generally uniform thickness, said elements having a configuration in near conformance to said contour of said anode cradle surface;

means for connecting said metal elements to a source of power; and, means for securing said elements to said cradle wherein said elements are drawn into mating engagement with said non-conductive surface and conforms to the predetermined contour thereof.

15. An apparatus as defined in claim 14 wherein:

said cathode is a cylindrical drum, rotatable about a generally horizontal axis, said anode cradle is semi-cylindrical in shape and generally conforms to said cathode; and, said titanium elements are elongated, generally rectangular stripe aligned generally parallel to the axis of said cathode.

16. An apparatus as defined in claim 15 wherein said means for securing said elements to said cradle is comprised of threaded rods extending from one side of said elements through said anode cradle.

17. An apparatus as defined in claim 14 wherein said anode cradle is generally a flat, metal plate formed into a semi-cylindrical shape having a generally uniform, non-conductive lining covering the exterior thereof.

18. An apparatus as defined in claim 14 wherein:

said elements are formed of a metal which is a member of the group of titanium, platinum, chromium, tantalum, columbium, stainless steel, or an alloy thereof, and include one or more mounting pins extending to one side thereof; and, said anode cradle includes a plurality of apertures therethrough dimensioned to receive said mounting pins.

19. An apparatus for electrodeposition of metal comprising:

a cell containing an electrolyte having a concentration of metal ions to be deposited;

a cathode at least partially immersed in said electrolyte; and, an anode essentially comprised of:

an anode carrier having an electrically non-conductive surface facing said cathode and said electrolytic fluid, and forming at least a portion of said cell, said carrier including a plurality of apertures extending therethrough into said cell, at least one deformable, generally flat metal anode having connector means extending to one side thereof, said connector means connectable to a source of power and dimensioned to be in registry with said apertures and to extend therethrough; and, fastener means operable to secure said anode to said cradle and to deform said anodes wherein said anodes assume the contour of said non-conductive surface and forms a fluid-tight seal therewith.

20. An apparatus as defined in claim 19 wherein:

said cathode is a drum rotatable about a generally horizontal axis and said anode carrier is a semi-cylindrical tank, said drum and said tank defining an annular gap therebetween.

21. An apparatus as defined in claim 20 further comprising means for introducing electrolytic solution under pressure into said gap.

22. An apparatus as defined in claim 21 further comprising means for confining said electrolytic solution within said gap.

23. An apparatus as defined in claim 22 wherein said means for confining is comprised of an annular seal at the ends of said drum, said seal being in sealing engagement with said anode carrier.

24. An apparatus as defined in claim 19 wherein said anode is formed from a metal which is from the group of titanium, platinum, chromium, tantalum, columbium, stainless steel, or an alloy thereof.

25. An apparatus as defined in claim 19 wherein connector means are pins secured to said anode, said pin extending through said aperture in said anode carrier.

26. An anode assembly for use with a cylindrical drum which is rotatable about a generally horizontal axis for electrodeposition of metal onto a surface, said anode assembly comprising:

an anode cradle having a semi-cylindrical, electrically non-conductive surface facing said drum, said cradle dimensioned to be positioned a predetermined distance below said drum to form an annular gap between said drum and said non-conductive surface;

a plurality of elongated, generally rectangular anode plates disposed, completely within said gap about the periphery of said drum, said anode plates oriented lengthwise generally parallel to the axis of said drum;

means extending through said anode cradle for mounting said anode plates to said non-conductive surface of said anode cradle said mounting means causing said anode plates to conform to the shape of said conductive surface and to form a fluid-tight seal therewith; and, connecting means external to said anode cradle for connecting said anode plates to sources of power.

27. An anode assembly as defined in claim 26 wherein:

said anode plates have a length generally equal to the length of said drum and a predetermined thickness wherein said anode plates are slightly deformable, said plates having a side-to-side radius of curvature slightly greater than the radius of curvature of said non-conductive surface, said connecting means causing said anode plates to deform and conform to the curvature of said non-conducting surface.

28. An anode assembly as defined in claim 27 wherein said mounting means is comprised of one or more pins extending from said anode plates through said non-conductive surface, and fastener means operable to draw said anode plates into a mating engagement with said non-conductive surface, wherein said plates conform to said surface.

29. An anode assembly as defined in claim 26 wherein:

said anode cradle includes a plurality of apertures extending therethrough and intersecting said gap;

said anode plates include a plurality of mounting pins extending to one side thereof, said mounting pins disposed in registry with said apertures and dimensioned to extend therethrough; and, said mounting means being operable to mount said anode plates to said non-conducting surface in fluid tight fashion, wherein an electrolytic fluid may be maintained in said gap.

30. An anode assembly as defined in claim 29 wherein said mounting pins are connectable to sources of power.

31. An anode assembly as defined in claim 26 wherein:

said anode plates have a side-to-side radius of curvature greater than the radius of curvature of said non-conductive surface of said anode cradle and have a thickness which permits said plates to be deformed a limited amount; and, said mounting means are operable to deform said anode plates wherein said plates assume the radius of curvature of said surface.

32. An anode assembly as defined in claim 31 wherein said mounting means is comprised of one or more pins extending from said anode plates through said non-conductive surface, and fastener means operable to draw said anode plates into a mating engagement with said non-conductive surface, wherein said plates conform to said surface.

33. An anode for use with a cylindrical drum which is rotatable about a generally horizontal axis for electrodeposition of metal onto a surface, said anode comprising:

a generally elongated, thin metallic plate having a length corresponding to the length of said drum, a width equal to a predetermined circumferential portion of the drum, and a thickness which permits said plates to be deformed a limited amount, said anode formed to have a side-to-side radius of curvature greater than the radius of curvature of said drum; and, a plurality of mounting pins extending from one side of said plates.

34. An anode as defined in claim 33 wherein said metal plates are formed from a metal which is a member of the group of titanium, platinum, chromium, tantalum, columbium, stainless steel, or an alloy thereof.

* * * * *